US008957534B2

(12) United States Patent
Keske

(10) Patent No.: US 8,957,534 B2
(45) Date of Patent: Feb. 17, 2015

(54) POWER GENERATION MOUNTING SYSTEM

(75) Inventor: Justin D. Keske, Elkhart Lake, WI (US)

(73) Assignee: Kohler Co., Kohler, WI (US)

( * ) Notice: Subject to any disclaimer, the term of this patent is extended or adjusted under 35 U.S.C. 154(b) by 260 days.

(21) Appl. No.: 13/544,315

(22) Filed: Jul. 9, 2012

(65) Prior Publication Data

US 2014/0008918 A1 Jan. 9, 2014

(51) Int. Cl.
*F02B 63/04* (2006.01)

(52) U.S. Cl.
USPC ..... 290/1 A; 290/1 B

(58) Field of Classification Search
USPC ..... 290/1 A, 1 B; 322/1; 123/2, 3; 74/16; 280/35
See application file for complete search history.

(56) References Cited

U.S. PATENT DOCUMENTS 2,895,695 A * 7/1959 Solomon ..... 410/46
4,089,386 A * 5/1978 Balchick ..... 180/294
4,693,455 A 9/1987 Andra
5,965,949 A 10/1999 Fukuda et al.
6,047,942 A 4/2000 Kennedy
6,325,364 B1 12/2001 Muramatsu
6,489,690 B1 * 12/2002 Hatsugai et al. ..... 290/1 A
6,677,684 B1 1/2004 Kennedy
7,082,896 B2 8/2006 Allen et al.
7,175,166 B2 2/2007 Akamatsu et al.
8,546,963 B2 * 10/2013 Peacock et al. ..... 290/1 A

* cited by examiner

*Primary Examiner* — Tho D Ta
(74) *Attorney, Agent, or Firm* — Schwegman Lundberg & Woessner, P.A.

(57) ABSTRACT

Some embodiments relate to a power generation system that includes a first side member and a second side member that is parallel to the first side member. At least one cross member extends between the first side member and the second side member. In some embodiments, the power generation system includes a first cross member and a second cross member. The first cross member includes a pair of flat mating surfaces that are parallel to the first cross member. The first cross member further includes a pair of angled mating surfaces that are at an angle relative to the first cross member. The power generation system further includes a power source that includes an alternator and an engine that drives the alternator to generate power. At least one of the engine and the alternator is mounted to the pair of flat mating surfaces or pair of angled mating surfaces.

20 Claims, 19 Drawing Sheets

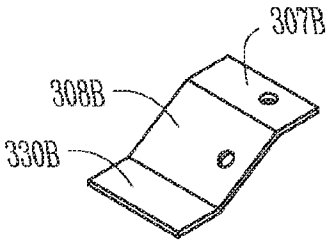
Fig. 28
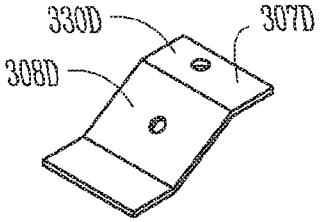

POWER GENERATION MOUNTING SYSTEM

TECHNICAL HELD

Embodiments pertain to a power generation mounting system, and more particularly to a power generation mounting system that readily permits engines and/or alternators to be mounted to flat or angled surfaces.

BACKGROUND

Some existing power generations systems include engines and/or alternators that are mounted to flat surfaces that are part of a support structure. Other existing power generations systems include engines and/or alternators that are mounted to angled surfaces that are part of a support structure (i.e., focused mounting).

There are no existing systems that provide for the ability to mount engines and/or alternators to flat surfaces and/or angled surfaces that are part of the same support structure. Therefore, one of the drawbacks with these existing systems is the relatively large number of components (and therefore costs) that are required to mount the engine and/or alternator to separate support structures.

Another drawback with these existing systems is that since the engines and/or alternators may only be flat mounted (or angled mounted), the systems may be inappropriately mounted for the particular environment (i.e., the system may be flat surface mounted when it is better suited to be angle surface mounted (or vice versa)).

BRIEF DESCRIPTION OF THE DRAWINGS

FIG. 28 shows example brackets that may be used in the system shown in FIGS. 19-27.

DETAILED DESCRIPTION

Figure 2:
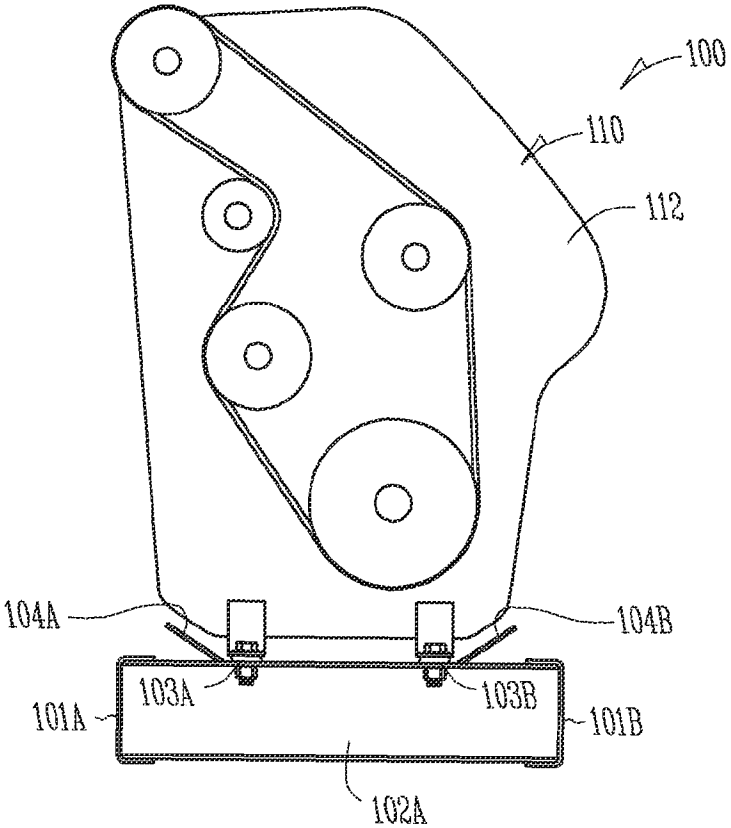
FIGS. 1-9 illustrate an example power generation system where cross members include both flat and angled mounting surfaces.
Figure 1:
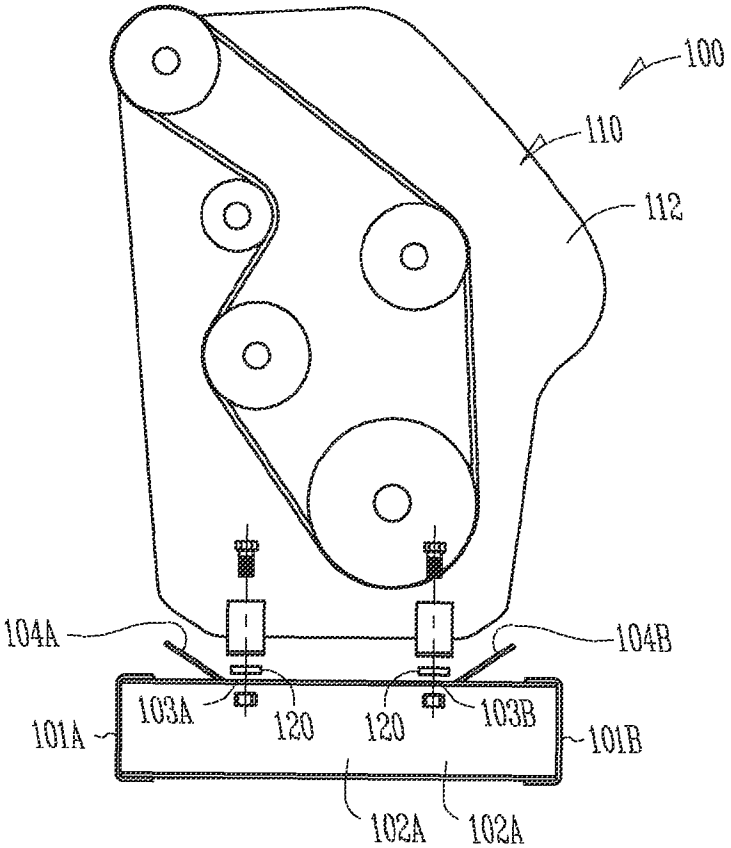
Figure 4:
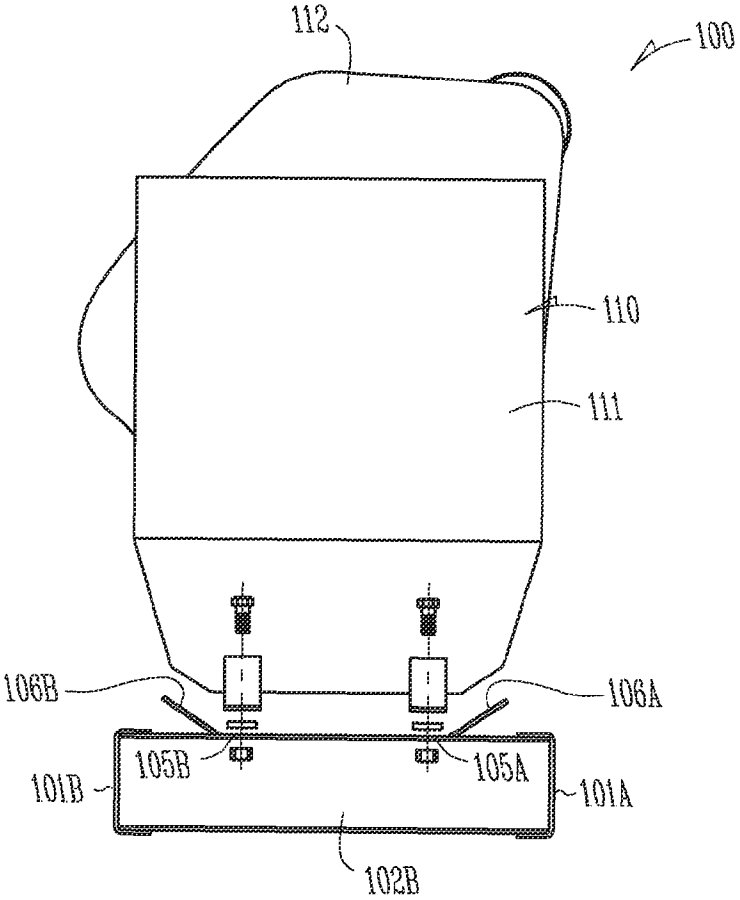

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

FIGS. 1-9 illustrate a power generation system 100 that includes a first side member 101A and a second side member 101B that is parallel to the first side member 101A. At least one cross member 102 extends between the first side member 101A and the second side member 101B. In the example embodiment that is illustrated in FIGS. 1-9, the power generation system 100 include a first cross member 102A and a second cross member 102B.

The first cross member 102A includes a pair of flat mating surfaces 103A, 103B that are parallel to the first cross member 102A. The first cross member 102A further includes a pair of angled mating surfaces 104A, 104B that are at an angle relative to the first cross member 102A.

The power generation system 100 further includes a power source 110 that includes an alternator 111 and an engine 112 that drives the alternator 111 to generate power. At least one of the engine 112 and the alternator 111 is mounted to the pair of flat mating surfaces 103A, 103B or the pair of angled mating surfaces 104A, 104B.

Figure 3:
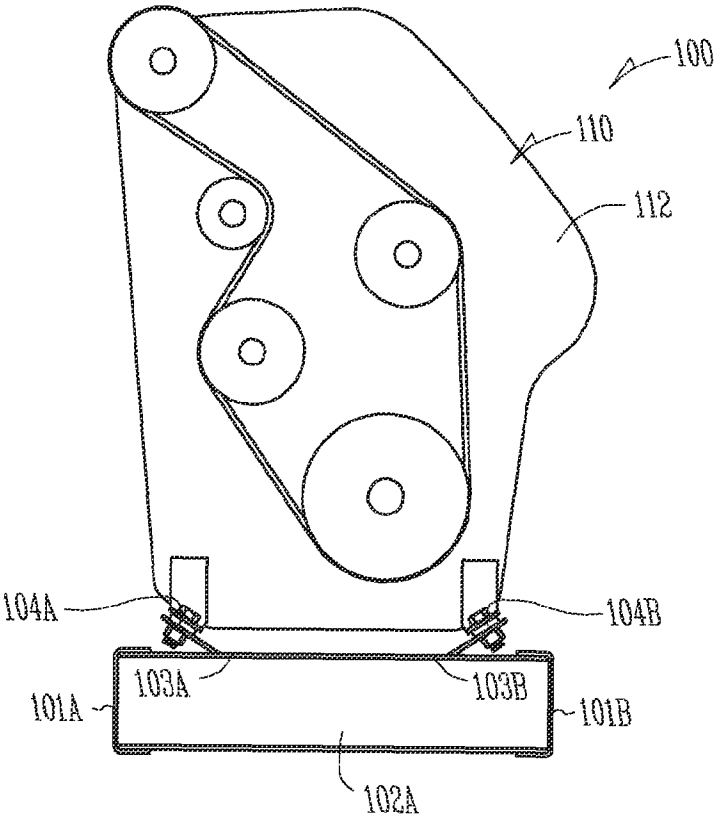
Figure 8:
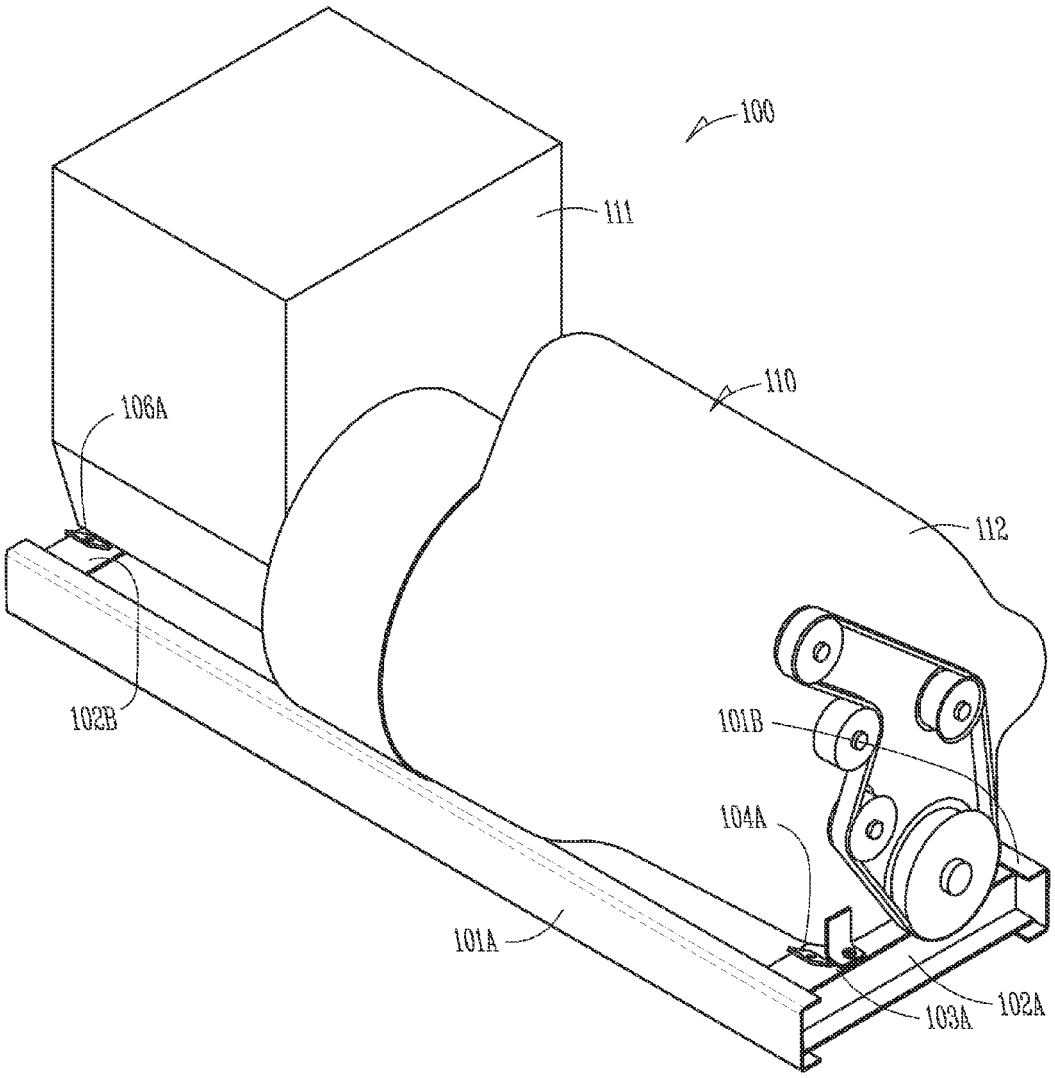
Figure 9:
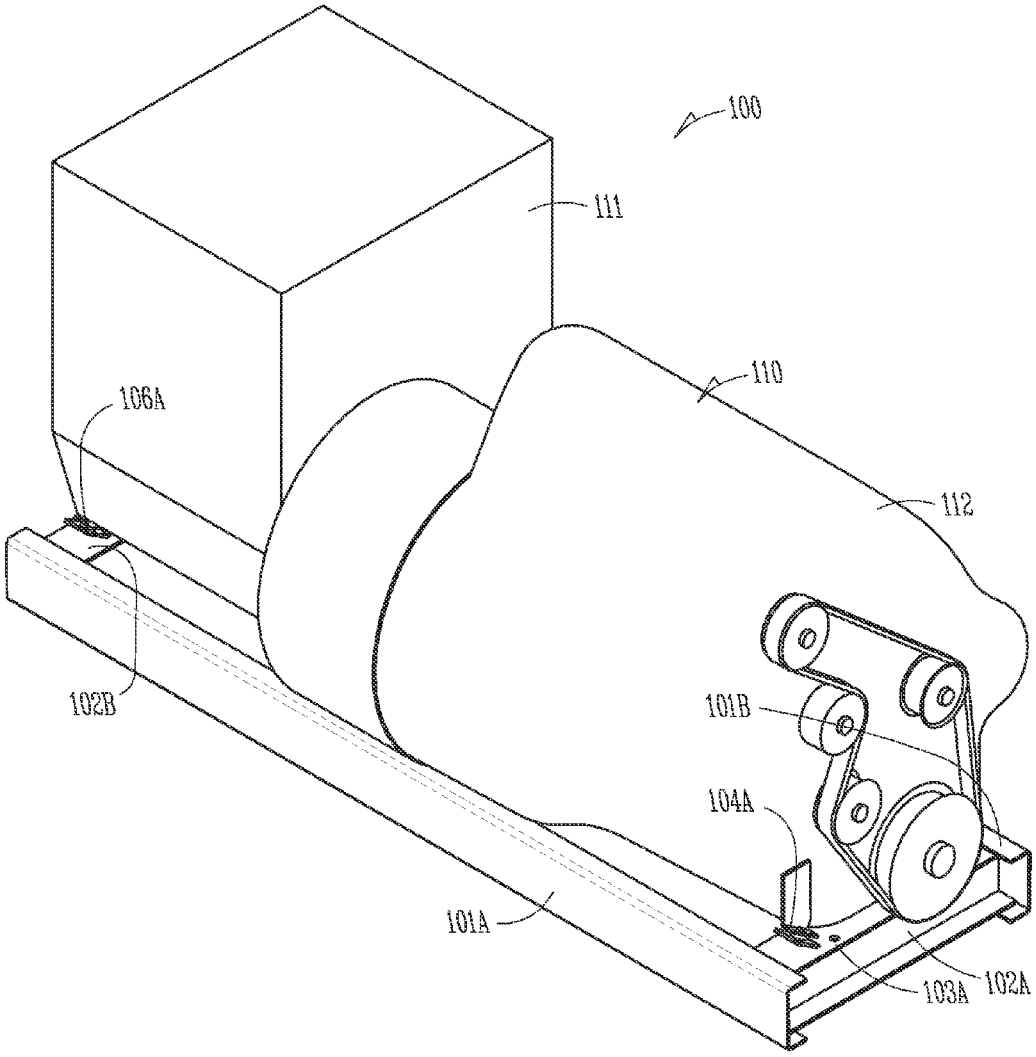

In the example embodiment that is illustrated in FIGS. 2 and 8, the engine 112 is mounted to the pair of flat mating surfaces 103A, 103B. In the example embodiment that is illustrated in FIGS. 3 and 9, the engine 112 is mounted to the pair of angled mating surfaces 104A, 104B.

In some embodiments, the second cross member 102B includes a pair of flat mating surfaces 105A, 105B that are parallel to the second cross member 102B. The second cross member 102B further includes a pair of angled mating surfaces 106A, 106B that are at an angle relative to the second cross member 102B.

Figure 6:
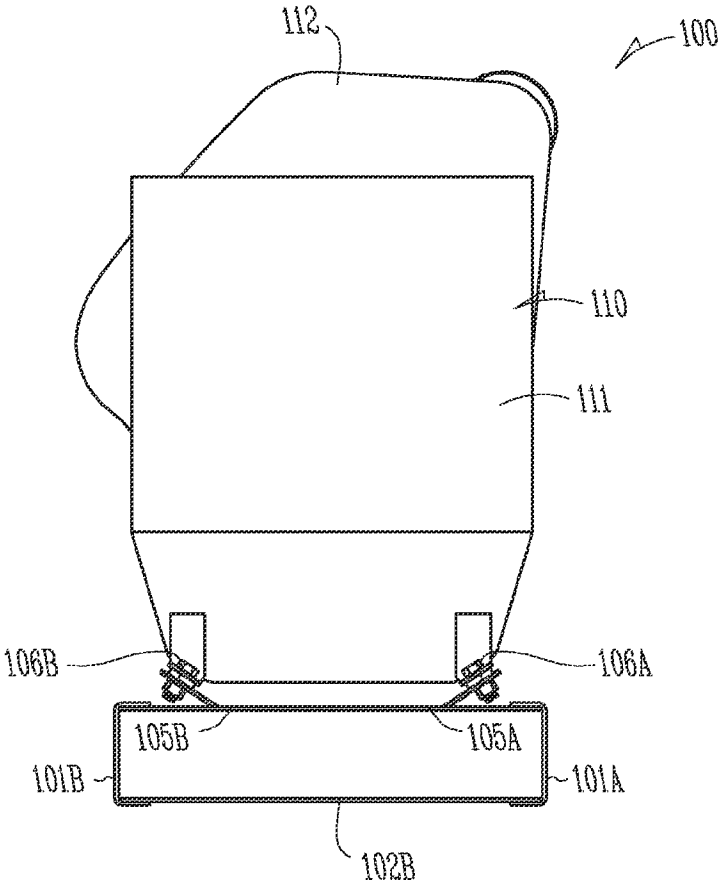
Figure 5:
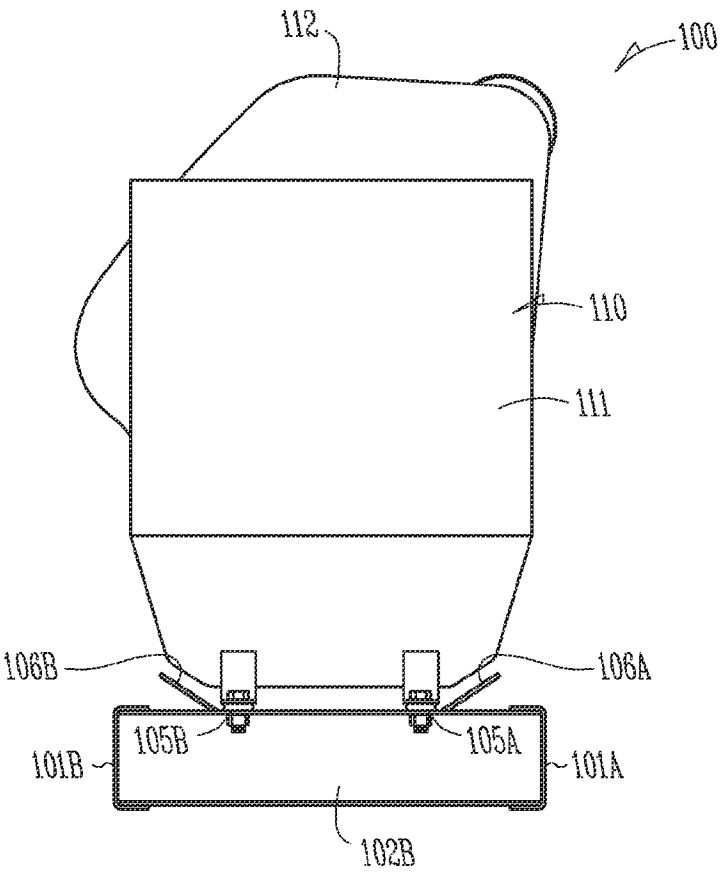
Figure 7:
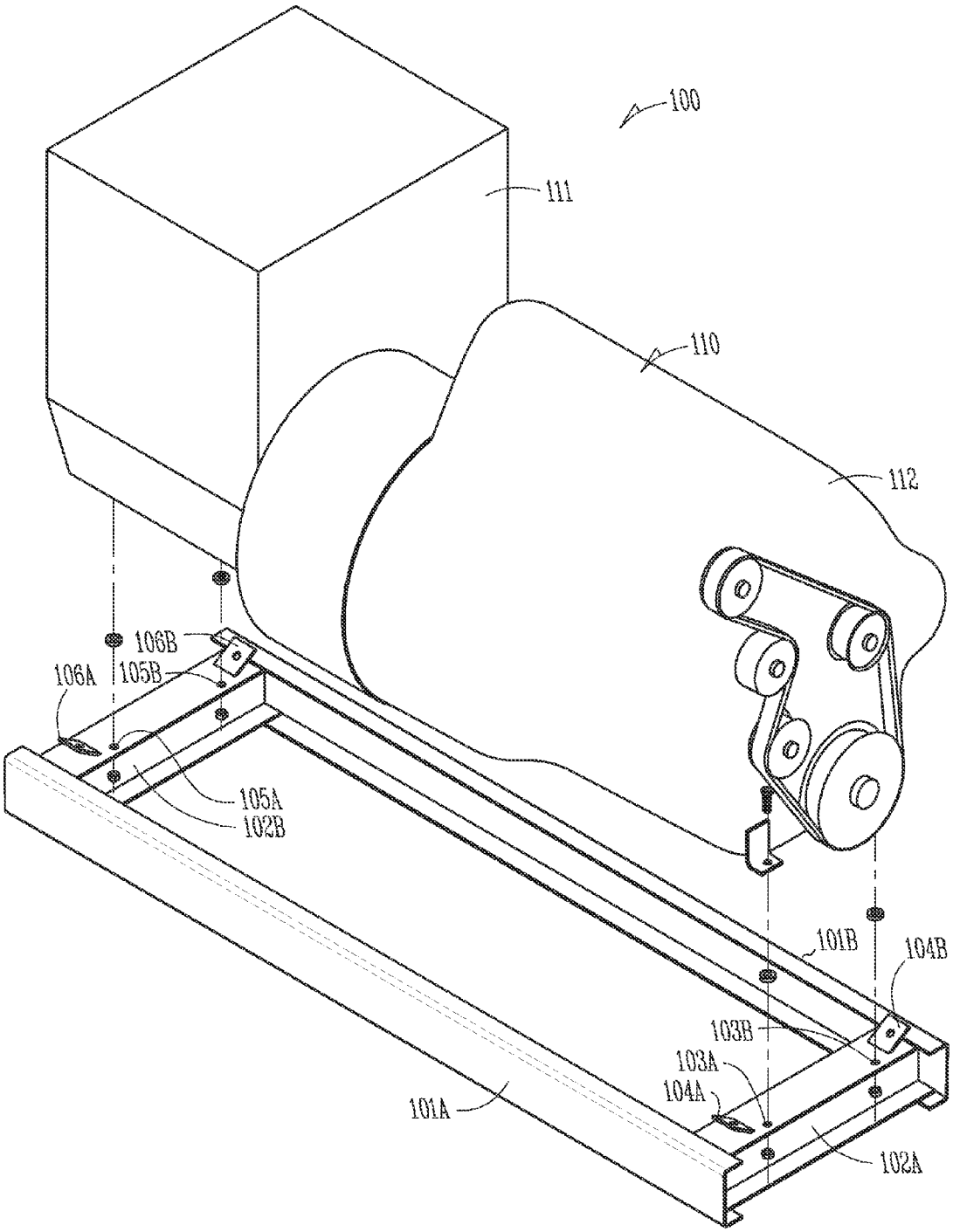

In the example embodiment that is illustrated in FIGS. 5 and 8, the alternator 111 is mounted to the pair of flat mating surfaces 105A, 105B. In the example embodiment that is illustrated in FIGS. 6 and 9, the alternator 111 is mounted to the pair of angled mating surfaces 106A, 106B.

The ability to mount the engine 112 and/or alternator 111 to either a flat or angled mounting surface that is included as part of the first and second cross members 102A, 102B reduces the number of components (and therefore costs) that are associated with mounting the engine 112 and/or alternator 111 to separate support structures.

Embodiments are also contemplated where power generation system 10 includes isolators 120. As an example, isolators 120 (shown most clearly in FIG. 1) may be between the first cross member 102A and the engine 112. As another example, isolators 120 may be between the second cross member 102B and the alternator 111. It should be noted that isolators may be included between any of the flat or angled surfaces that are shown in FIGS. 1-9.

FIGS. 10-18 illustrate a power generation system 200 that includes a first side member 201A and a second side member 201B that is parallel to the first side member 201A. At least one cross member 202 extends between the first side member 201A and the second side member 201B. In the example embodiment that is illustrated in FIGS. 10-18, the power generation system 200 include a first cross member 202A and a second cross member 202B (shown most clearly in FIG. 16).

The first side member 201A includes a first flat mating surface 203A that is parallel to the first cross member 202A and an angled mating surface 204A, that is at an angle relative to the first cross member 202A. The second side member 201B includes a first flat mating surface 203B that is parallel to the first cross member 202A and an angled mating surface 204B that is at an angle relative to the first cross member 202A.

The power generation system 200 further includes a power source 210 that includes an alternator 211 and an engine 212 that drives the alternator 211 to generate power. At least one of the engine 212 and the alternator 211 is mounted to the pair of flat mating surfaces 203A, 203B or the pair of angled mating surfaces 204A, 204B.

Figure 11:
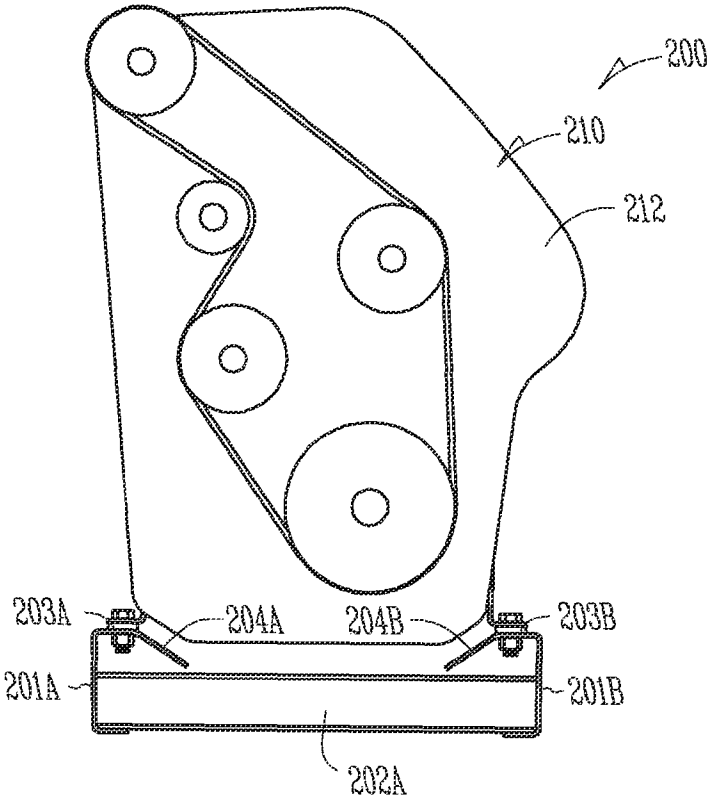
FIGS. 10-18 illustrate an example power generation system where side members include both flat and angled mounting surfaces.
Figure 12:
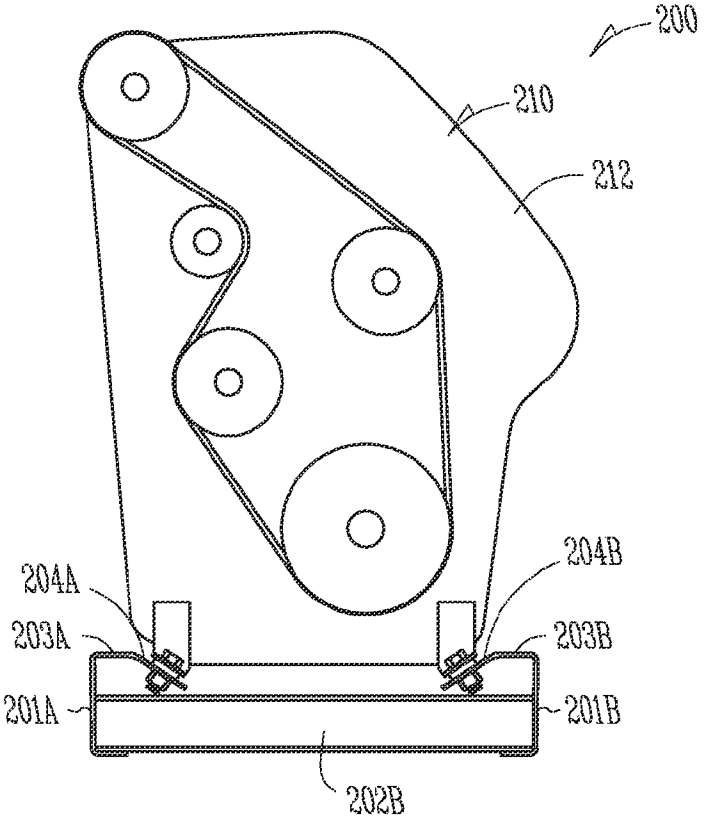
Figure 17:
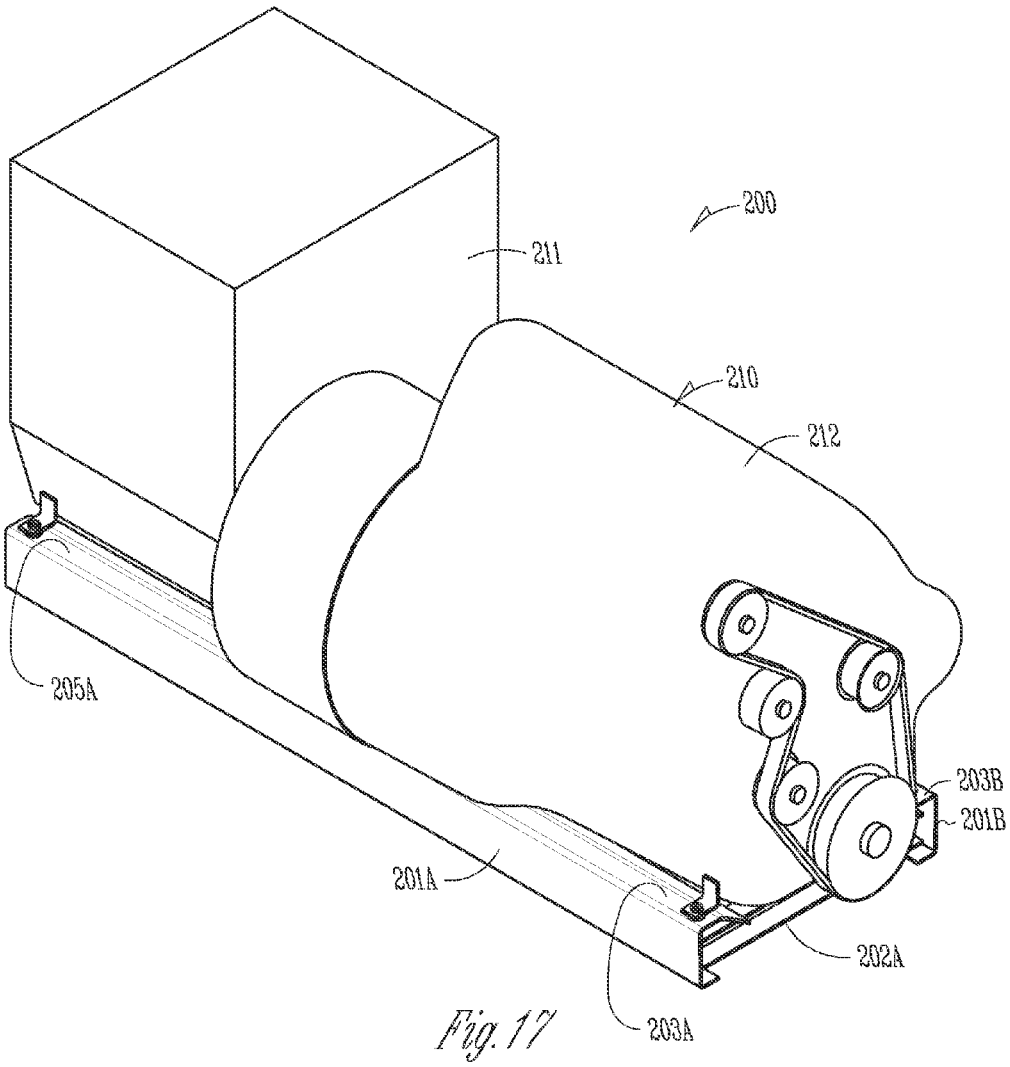
Figure 18:
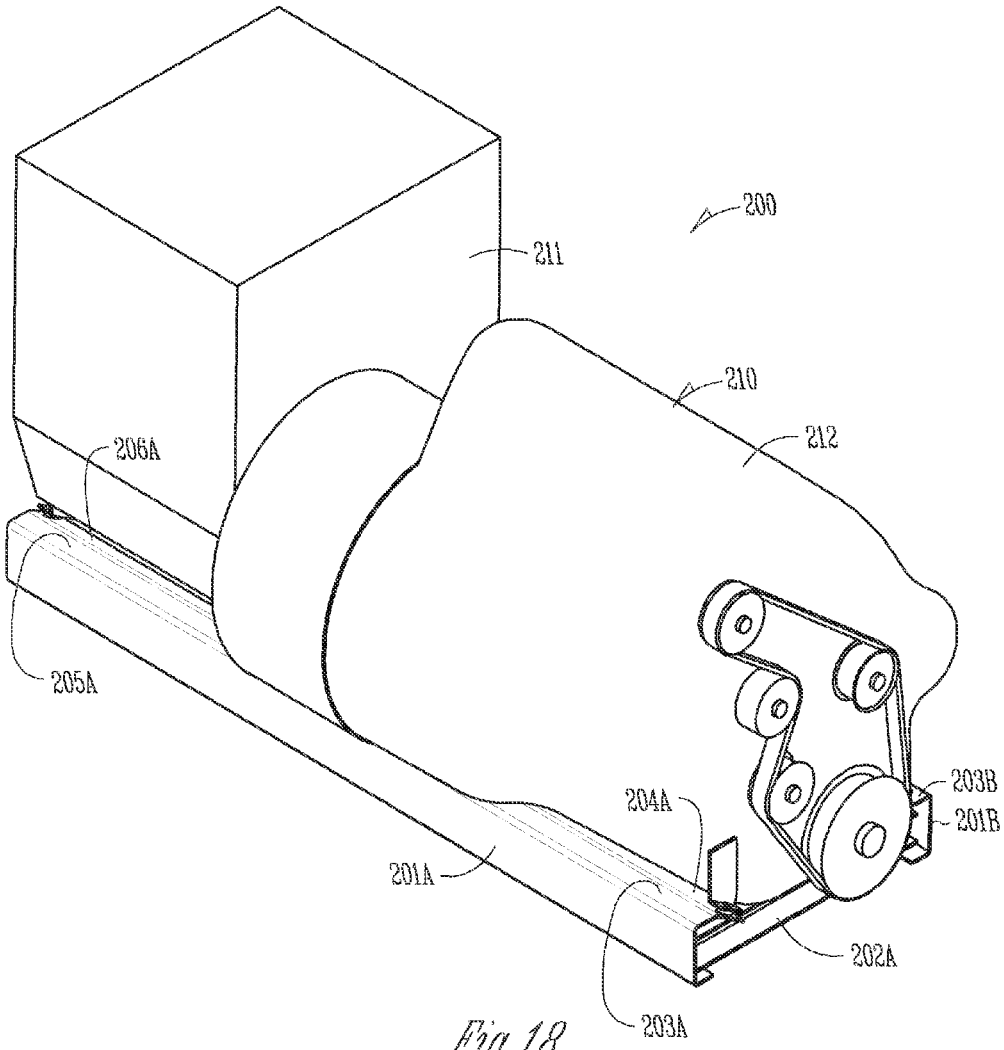

In the example embodiment that is illustrated in FIGS. 11 and 17, the engine 212 is mounted to the pair of fiat mating surfaces 203A, 203B, in the example embodiment that is illustrated in FIGS. 12 and 18, the engine 212 is mounted to the pair of angled mating surfaces 204A, 204B.

In some embodiments, the first side member 201A includes a second flat mating surface 205A that is parallel to the second cross member 202B. The first side member 201A further includes an angled mating surface 206A that is at an angle relative to the second cross member 202B.

In addition, the second side member 201B includes a second flat mating surface 205B that is parallel to the second cross member 202B. The second side member 201B further includes an angled mating surface 206B that is at an angle relative to the second cross member 202B.

Figure 15:
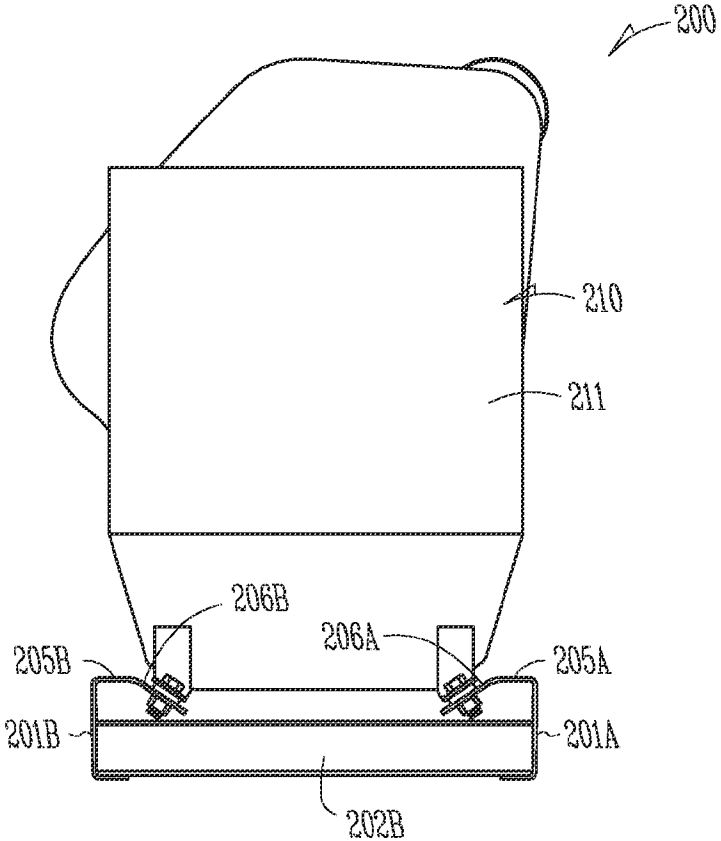
Figure 14:
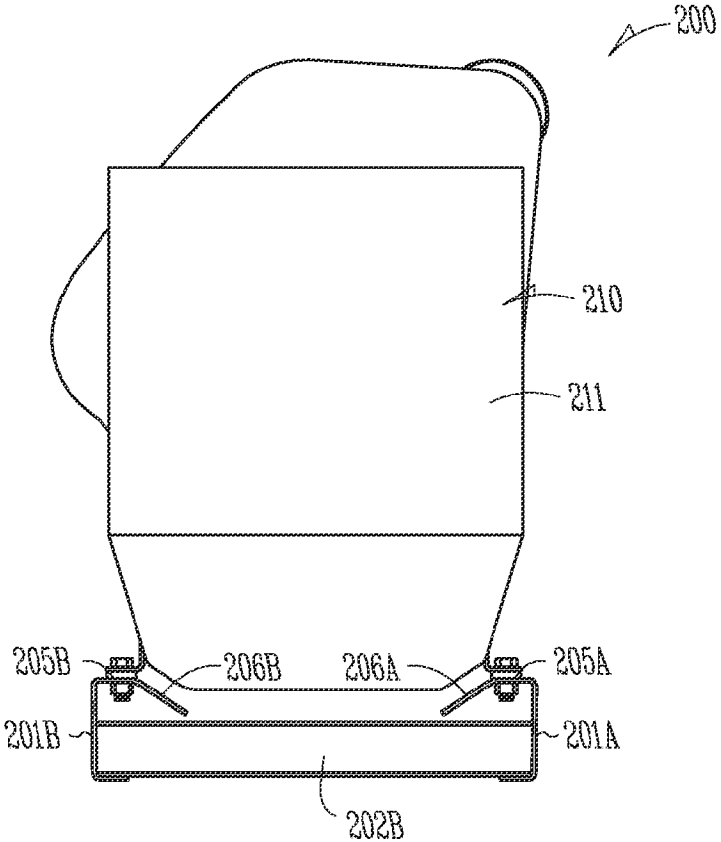
Figure 16:
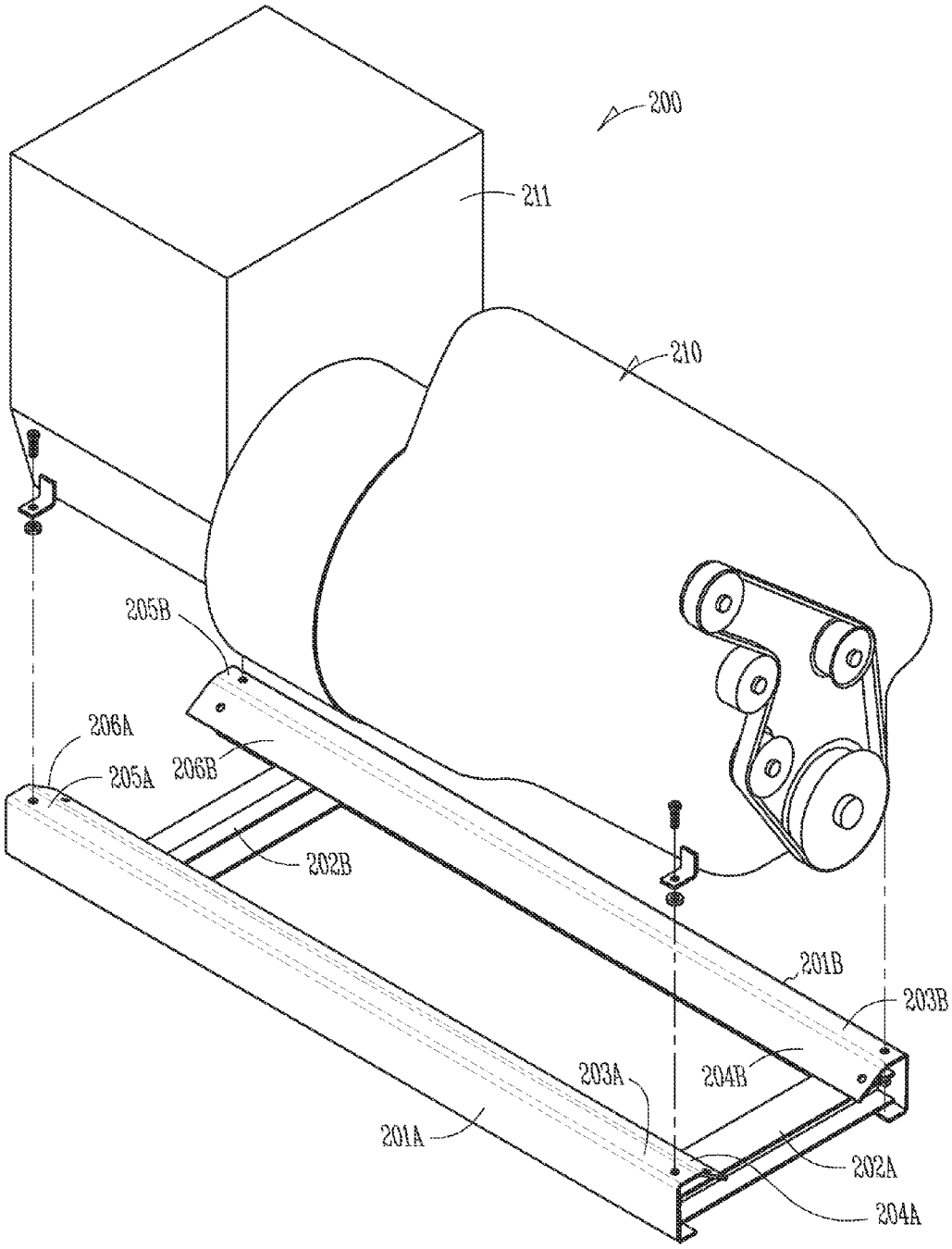

In the example embodiment that is illustrated in FIG. 14, the alternator 211 is mounted to the pair of flat mating surfaces 205A, 205B, in the example embodiment that is illustrated in FIG. 15, the alternator 211 is mounted to the pair of angled mating surfaces 206A, 206B.

The ability to mount the engine 212 and/or alternator 211 to either a fiat or angled mounting surface that is included as part of the first and second side members 201A, 201B reduces the number of components (and therefore costs) that are associated with mounting the engine 212 and/or alternator 211 to separate support structures.

Figure 10:
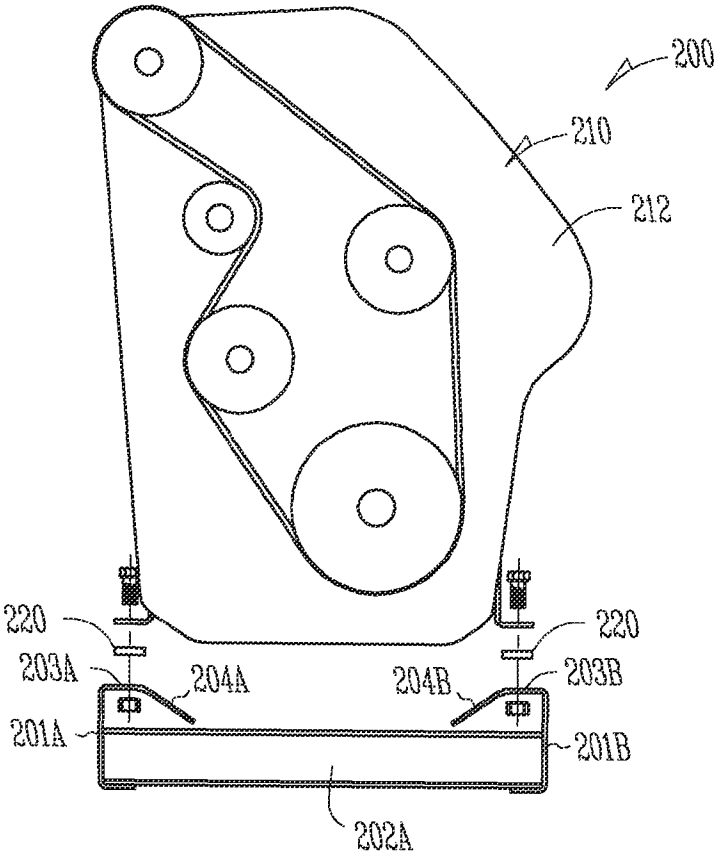
Figure 13:
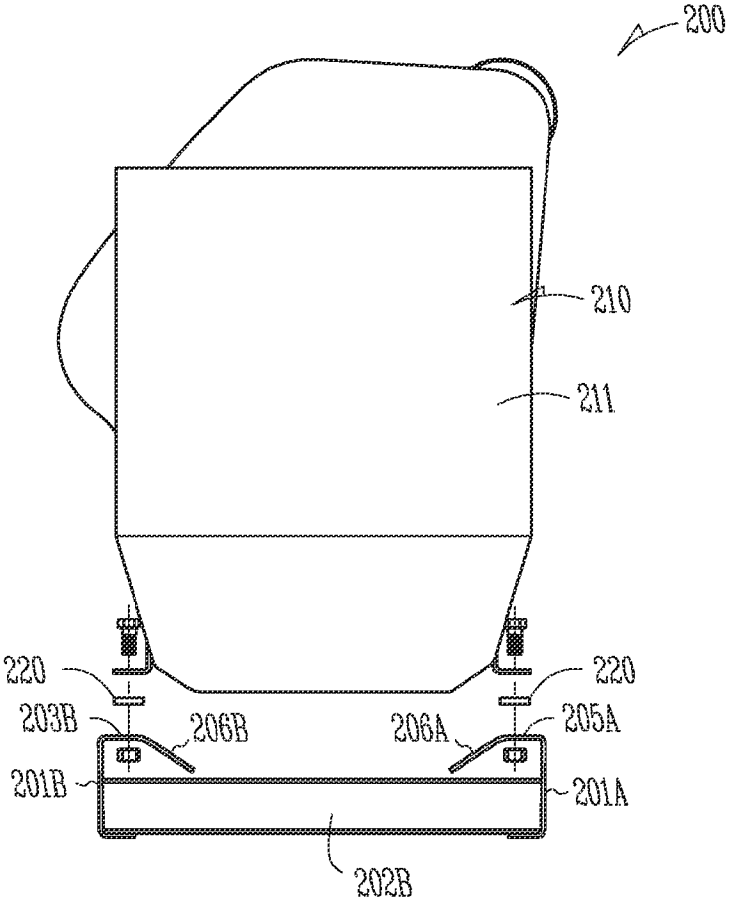

As discussed above, embodiments are also contemplated where power generation system 200 includes isolators 220 (shown most clearly in FIGS. 10 and 13). As an example, isolators 220 may be between the first side member 201A and the engine 212. As another example, isolators 220 may be between the second side member 201B and the alternator 211. It should be noted that isolators may be included between any of the flat or angled surfaces that are shown in FIGS. 10-18.

FIGS. 19-27 illustrate a power generation system 300 that includes a first side member 301A and a second side member 301B that is parallel to the first side member 301A. At least one cross member 302 extends between the first side member 301A and the second side member 301B. In the example embodiment that is illustrated in FIGS. 19-27, the power generation system 300 includes a first cross member 302A and a second cross member 302B.

The power generation system 300 further includes a first bracket 330A that is mounted to the first side member 301A and/or the first cross member 302A. The first bracket 330A includes a flat mating surface 307A that is parallel to the first cross member 302A and an angled mating surface 308A that is at an angle relative to the first cross member 302A.

The power generation system 300 further includes a second bracket 330B that is mounted to the second side member 301B and/or the first cross member 302A. The second bracket 330B includes a fiat mating surface 307B that is parallel to the first cross member 302A and an angled mating surface 308B that is at an angle relative to the first cross member 302A.

The power generation system 300 further includes a power source 310 that includes an alternator 311 and an engine 312 that drives the alternator 311 to generate power. At least one of the engine 312 and the alternator 311 is mounted to the pair of flat mating surfaces 307A, 307B or the pair of angled mating surfaces 308A, 308B.

Figure 20:
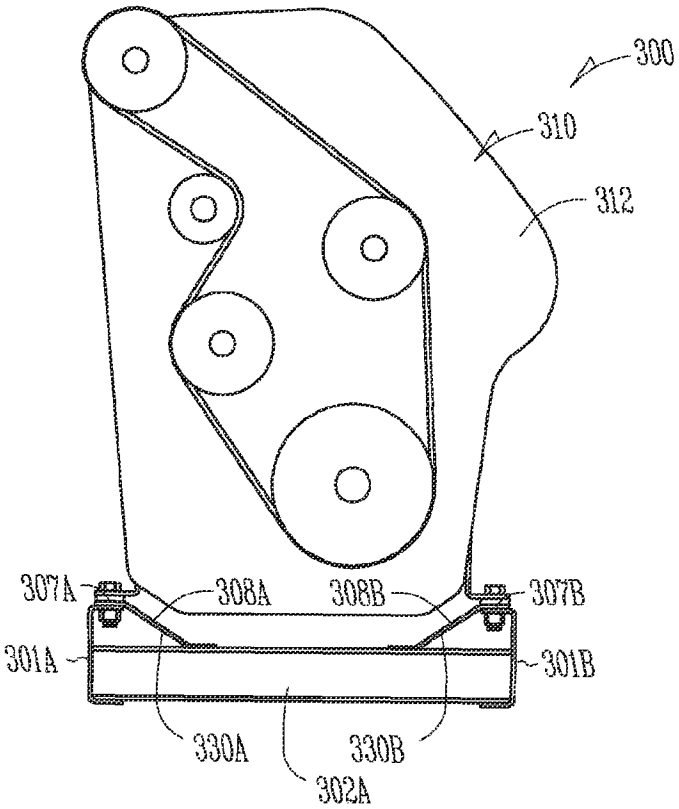
FIGS. 19-27 illustrate an example power generation system where example brackets are mounted to either the side members and/or the cross members and include both flat and angled mounting surfaces.
Figure 21:
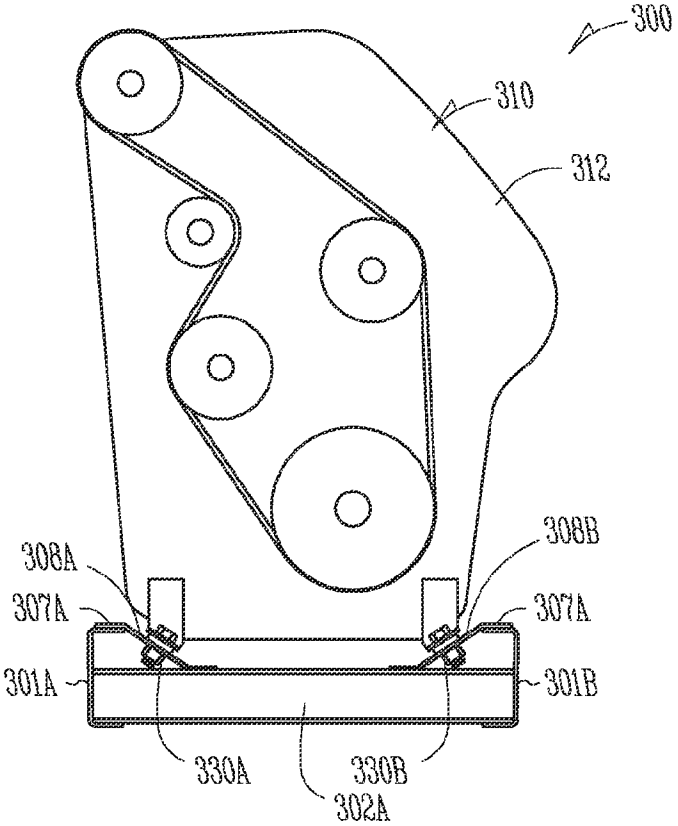
Figure 26:
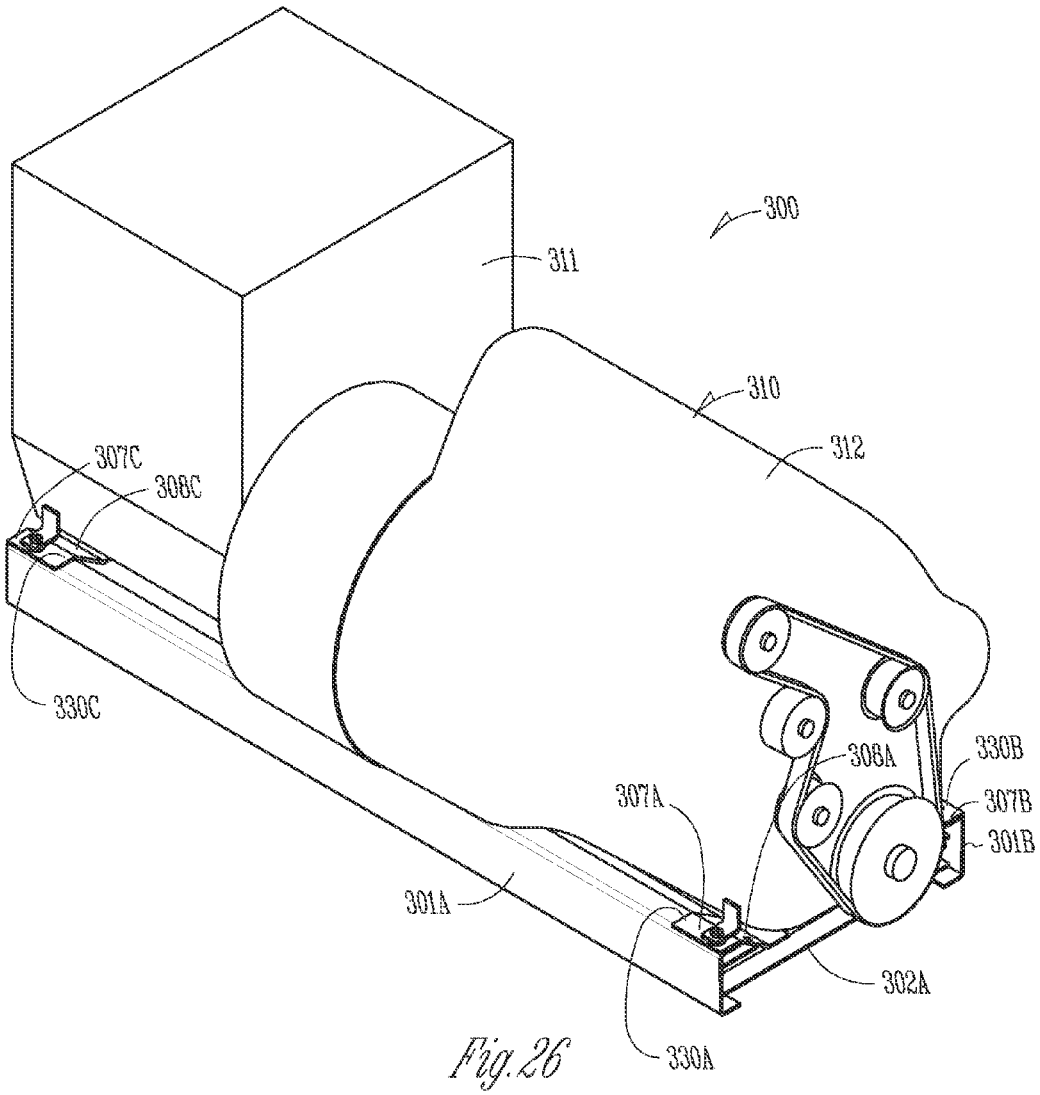
Figure 27:
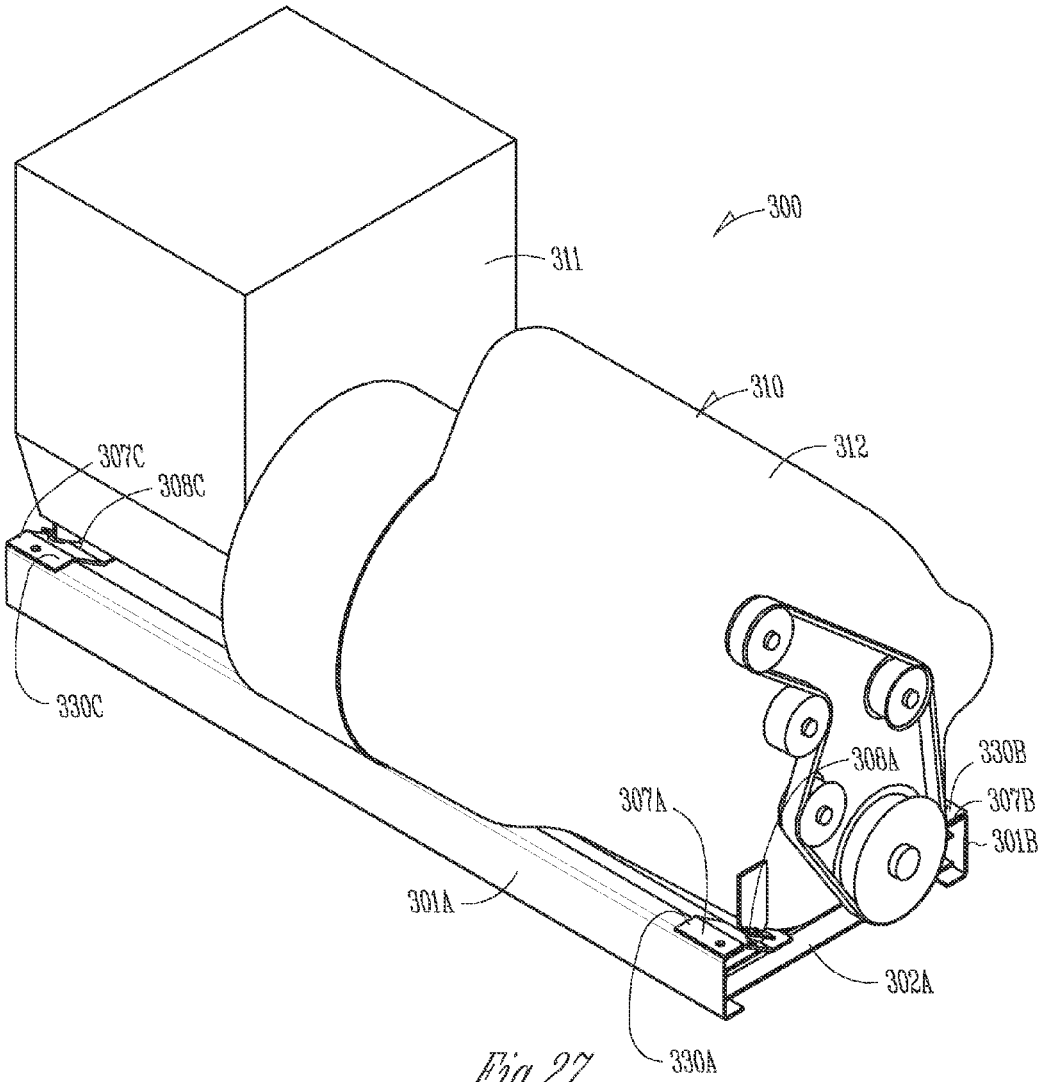

In the example embodiment that is illustrated in FIGS. 20 and 26, the engine 312 is mounted to the pair of flat mating surfaces 307A, 307B. In the example embodiment that is illustrated in FIGS. 21 and 27, the engine 312 is mounted to the pair of angled mating surfaces 308A, 308B.

Embodiments are also contemplated where power generation system includes a third bracket 330C (shown most clearly in FIG. 25) that includes a flat mating surface 307C that is parallel to the second cross member 302B and an angled mating surface 308C that is at an angle relative to the second cross member 302B. In addition, the power generation system 300 may further include a fourth bracket 330D (shown most clearly in FIG. 25) that includes a flat mating surface 307D that is parallel to the second cross member 302B and an angled mating surface 308D that is at an angle relative to the second cross member 302B.

Figure 24:
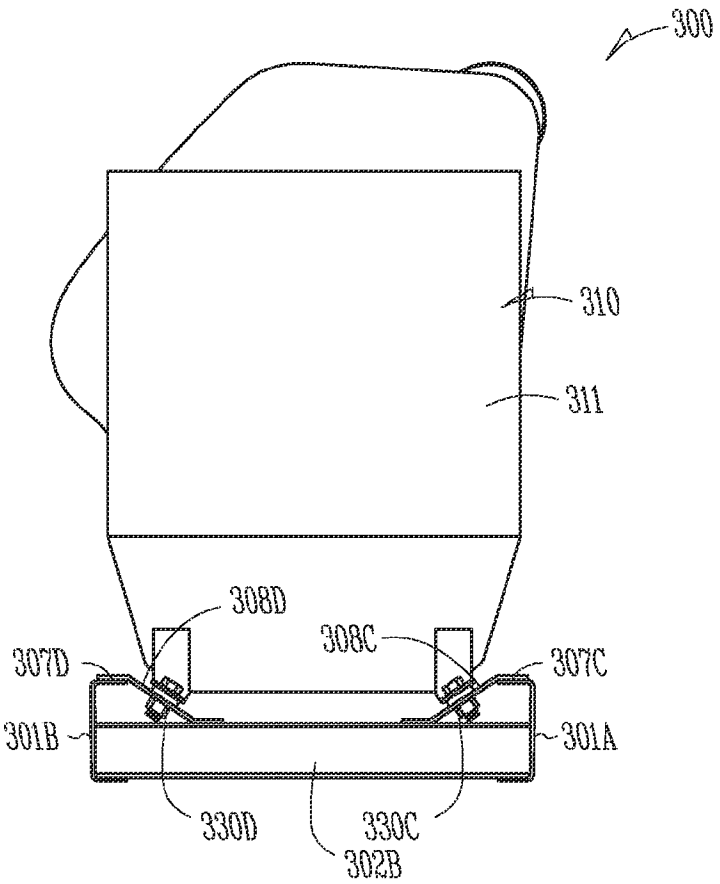
Figure 23:
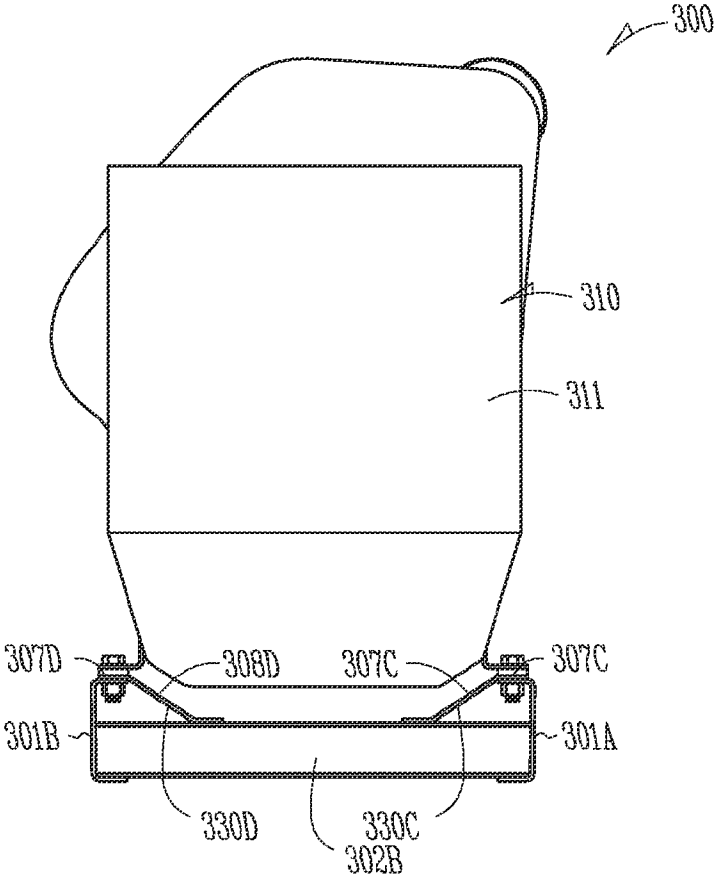
Figure 25:
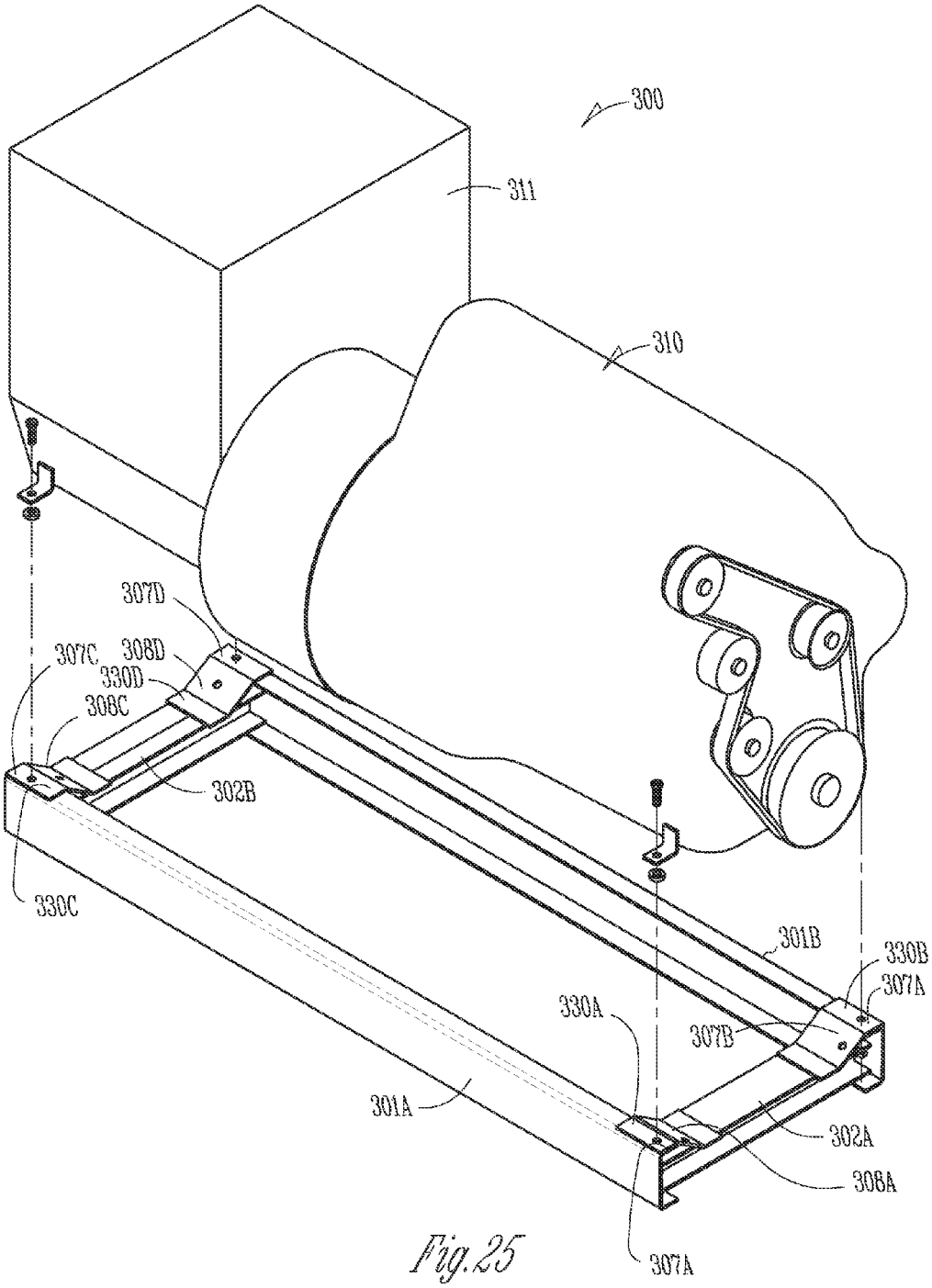

In the example embodiment that is illustrated in FIGS. 23 and 26, the alternator 311 is mounted to the pair of flat mating surfaces 307C, 307D. In the example embodiment that is illustrated in FIGS. 24 and 27, the alternator 311 is mounted to the pair of angled mating surfaces 308C, 308D.

The ability to mount the engine 312 and/or alternator 311 to either a flat or angled mounting surface that is included as part of the first, second, third and/or fourth brackets 330A, 330B, 330C, 330D reduces the number of components (and therefore costs) that are associated with mounting the engine 312 and/or alternator 311 to separate support structures.

Figure 19:
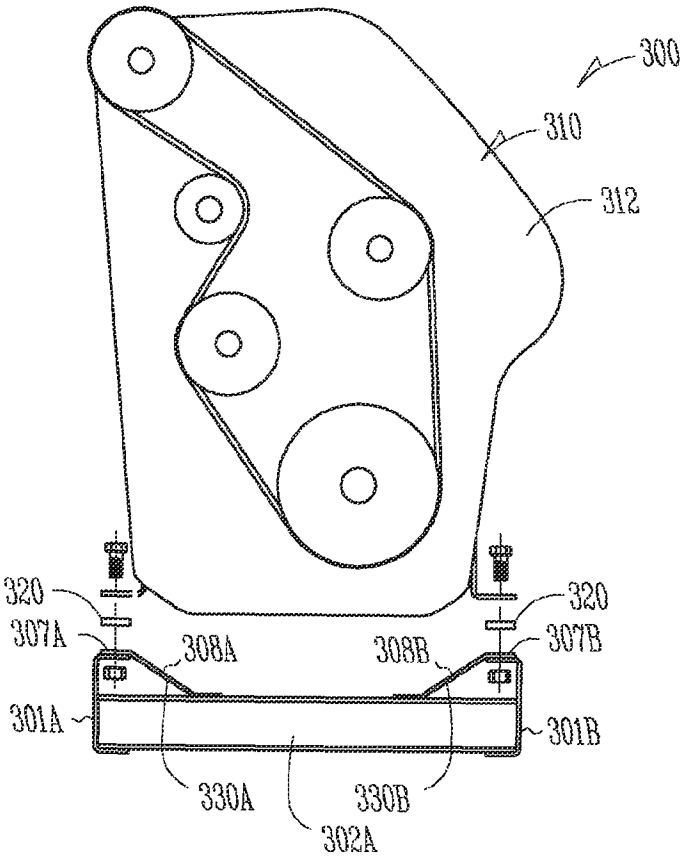
Figure 22:
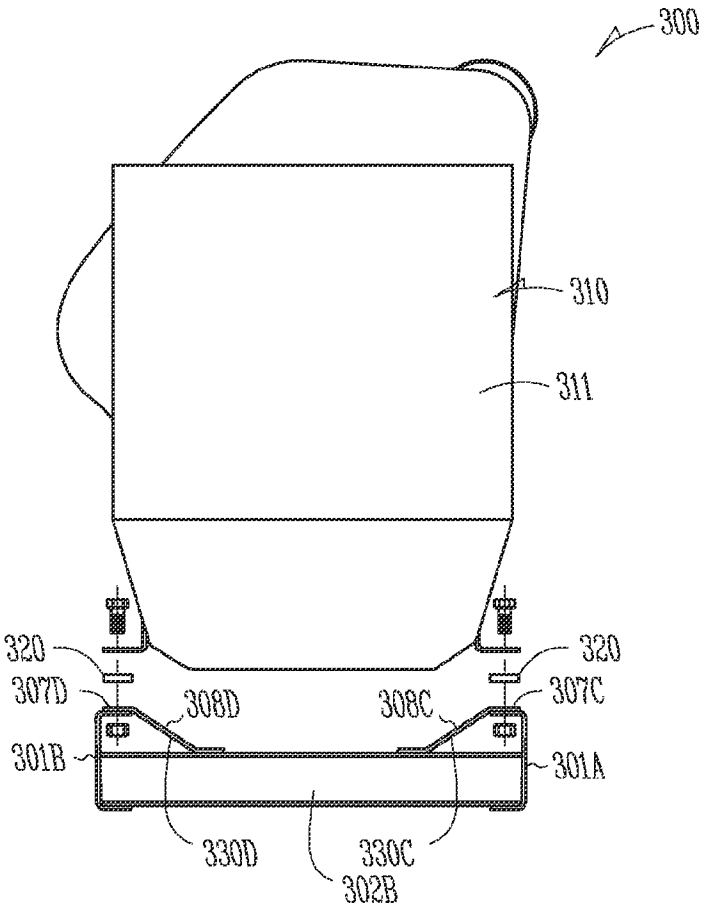

Embodiments are also contemplated where power generation system 300 includes isolators 320 (shown most clearly in FIGS. 19 and 22). As an example, isolators 320 may be between the first and second brackets 330A, 330B and the engine 312. As another example, isolators 320 may be between the third and fourth brackets 330C, 330D and the alternator 311. It should be noted that isolators may be included between any of the flat or angled surfaces that are shown in FIGS. 19-27.

FIG. 28 shows example brackets 330B, 330D separate from the rest of the system 300. It should be noted that any of the brackets that are used in the system 300 may take a variety of shapes, sizes and points of attachment (including the flat and angled surfaces that are part of such brackets).

The example power generation systems 100, 200, 300 described herein may be more suited for flat surface mounting while at other times the power generation systems 100, 200, 300 described herein may be more suited for angled surface mounting. The determination as to whether to utilize flat surface mounting or angled surface mounting will usually depend in part on the environment where the power generation systems 100, 200, 300 are to be located.

In addition, the example power generation systems 100, 200, 300 described herein provide manufacturers of such systems with the ability to readily change the mounting arrangement (flat or angled) that is required (and possibly changed) by a customer. As an example, the engines and/or generators in such systems may need to be changed between flat and angled mounting surfaces based on customer requests.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A power generation system comprising:

a first side member;

a second side member that is parallel to the first side member;

at least one cross member extending between the first side member and the second side member, wherein the cross member includes a pair of flat mating surfaces that are parallel to the at least one cross member and a pair of angled mating surfaces that are at an angle relative to the at least one cross member; and a power source that includes an alternator and an engine that drives the alternator to generate power, wherein at least one of the engine and the alternator is mounted to the pair of flat mating surfaces or the pair of angled mating surfaces.

2. The power generation system of claim 1, further comprising a pair of isolators, each of the isolators being between the at least one cross member and the power source.

3. The power generation system of claim 1, wherein the power generation system includes two cross members extending between the first side member and the second side member, wherein each cross member includes a pair of flat mating surfaces and a pair of angled mating surfaces, wherein the engine is mounted to the pair of flat mating surfaces or the pair of angled mating surfaces on one cross member, and the alternator is mounted to the pair of flat mating surfaces or the pair of angled mating surfaces on the other cross member.

4. The power generation system of claim 3, further comprising:

a first pair of isolators, each of the isolators in the first pair of isolators being between the one of the cross members and the engine; and a second pair of isolators, each of the isolators in the second pair of isolators being between the other of the cross members and the alternator.

5. The power generation system of claim 3, wherein the engine is mounted to the pair of flat mating surfaces on one cross member, and the alternator is mounted to the pair of flat mating surfaces on the other cross member.

6. The power generation system of claim 3, wherein the engine is mounted to the pair of angled mating surfaces on one cross member and the alternator is mounted to the pair of angled mating surfaces on the other cross member.

7. A power generation system comprising:

a first side member;

a second side member that is parallel to the first side member;

at least one cross member extending between the first side member and the second side member, wherein the first side member includes a flat mating surface that is parallel to the at least one cross member and an angled mating surface that is at an angle relative to the at least one cross member, and the second side member includes a flat mating surface that is parallel to the at least one cross member and an angled mating surface that is at an angle relative to the at least one cross member; and a power source that includes an alternator and an engine that drives the alternator to generate power, wherein at one least of the engine and the alternator is mounted to the flat mating surfaces on the first and second side members or the angled mating surfaces on the first and second side members.

8. The power generation system of claim 7, further comprising a pair of isolators, one of the isolators being between the first side member and the power source and the other of isolator being between the second side member and the power source.

9. The power generation system of claim 7, wherein the power generation system includes two cross members extending between the first side member and the second side member, wherein the first side member includes a pair of flat mating surfaces and a pair of angled mating surfaces, and the second side member includes a pair of flat mating surfaces and a pair of angled mating surfaces, wherein the engine is mounted to one of the flat mating surfaces or one of the angled mating surfaces on the first side member and the second side member, and wherein the alternator is mounted to one of the flat mating surfaces or one of the angled mating surfaces on the first side member and the second side member.

10. The power generation system of claim 9, further comprising:

a first pair of isolators, each of the isolators in the first pair of isolators being between the first side member and the engine; and a second pair of isolators, each of the isolators in the second pair of isolators being between the second member and the alternator.

11. The power generation system of claim 9, wherein the engine is mounted to the flat mating surfaces on the first side member and the second side member, and the alternator is mounted to the flat mating surfaces on the first side member and the second side member.

12. The power generation system of claim 9, wherein the engine is mounted to one of the angled mating surfaces on the first side member and the second side member, and the alternator is mounted to the angled mating surfaces on the first side member and the second side member.

13. A power generation system comprising:

a first side member;

a second side member that is parallel to the first side member;

at least one cross member extending between the first side member and the second side member;

a first bracket mounted to at least one of the first side member or the at least one cross member, the first bracket including a flat mating surface that is parallel to the at least one cross member and an angled mating surface that is at an angle relative to the at least one cross member;

a second bracket mounted to at least one of the second side member or the at least one cross member, the second bracket including a flat mating surface that is parallel to the at least one cross member and an angled mating surface that is at an angle relative to the at least one cross member; and a power source that includes an alternator and an engine that drives the alternator to generate power, wherein at least one of the engine and the alternator is mounted to the flat mating surfaces on the first and second brackets or the angled mating surfaces on the first and second brackets.

14. The power generation system of claim 13, further comprising a pair of isolators, one of the isolators being between the first bracket and the power source and the other of isolator being between the second bracket and the power source.

15. The power generation system of claim 13, wherein the power generation system includes two cross members extending between the first side member and the second side member, and further comprising:

a third bracket that includes a flat mating surface that is parallel to the at least one cross member and an angled mating surface that is at an angle relative to the at least one cross member; and a fourth bracket that includes a flat mating surface that is parallel to the at least one cross member and an angled mating surface that is at an angle relative to the at least one cross member; and wherein first and second brackets are mounted the first cross member and the third and fourth brackets are mounted to the second cross member.

16. The power generation system of claim 15, wherein the alternator is mounted to the flat mating surfaces on the first and second brackets, and the engine is mounted to the flat mating surfaces on the third and fourth brackets.

17. The power generation system of claim 15, wherein the alternator is mounted to the angled mating surfaces on the first and second brackets, and the engine is mounted to the angled mating surfaces on the third and fourth brackets.

18. The power generation system of claim 13, further comprising:

a third bracket that includes a flat mating surface that is parallel to the at least one cross member and an angled mating surface that is at an angle relative to the at least one cross member; and a fourth bracket that includes a flat mating surface that is parallel to the at least one cross member and an angled mating surface that is at an angle relative to the at least one cross member; and wherein first and third brackets are mounted the first side member and the second and fourth brackets are mounted to the second side member.

19. The power generation system of claim 18, wherein the alternator is mounted to the flat mating surfaces on the first and second brackets, and the engine is mounted to the flat mating surfaces on the third and fourth brackets.

20. The power generation system of claim 18, wherein the alternator is mounted to the angled mating surfaces on the first and second brackets, and the engine is mounted to the angled mating surfaces on the third and fourth brackets.

* * * * *